United States Patent [19]

Tittert

[11] Patent Number: 4,539,974

[45] Date of Patent: Sep. 10, 1985

[54] TEMPERATURE CONTROLLED FUEL GAS THROUGHFLOW VALVE

[75] Inventor: Curt Tittert, Dreieich-Götzenheim, Fed. Rep. of Germany

[73] Assignee: Braun Aktiengesellschaft, Kronberg, Fed. Rep. of Germany

[21] Appl. No.: 694,485

[22] PCT Filed: Oct. 9, 1982

[86] PCT No.: PCT/DE82/00194

§ 371 Date: Jun. 6, 1983

§ 102(e) Date: Jun. 6, 1983

[87] PCT Pub. No.: WO83/01369

PCT Pub. Date: Apr. 28, 1983

Related U.S. Application Data

[63] Continuation of Ser. No. 509,466, Jun. 6, 1983, abandoned.

[30] Foreign Application Priority Data

Oct. 14, 1981 [DE] Fed. Rep. of Germany ..... 3140799
Jan. 28, 1982 [DE] Fed. Rep. of Germany ..... 3202720

[51] Int. Cl.[3] ..... A45D 1/04
[52] U.S. Cl. ..... 126/409; 132/37 R
[58] Field of Search ..... 126/409, 408; 431/326, 431/83, 268; 132/33 R, 37 R; 222/3

[56] References Cited

U.S. PATENT DOCUMENTS

| | | | |
|---|---|---|---|
| 4,327,752 | 5/1982 | Hickel | 126/409 X |
| 4,354,482 | 10/1982 | Beiselker | 126/409 |
| 4,361,133 | 11/1982 | Bonnema | 126/408 |
| 4,374,528 | 2/1983 | Tittert | 126/409 X |
| 4,382,448 | 5/1983 | Tittert | 126/409 X |

*Primary Examiner*—Randall L. Green
*Attorney, Agent, or Firm*—Raymond J. De Vellis

[57] ABSTRACT

A hair curling unit, for example a curling iron, which has a catalytically acting heating device, wherein a regulator device is situated between the gas supply chamber which contains the fuel gas and the winding body. The movable valve element (13) of said regulation device is guided in an integrally designed regulator frame (40). Here, the regulator frame also comprises the valve seat (33), the bearing pin (34) for the regulating lever (16), and the spring collet (41) for the bimetallic temperature measuring element. The regulator device, as an independent component, is solidly connected with the handle part which encloses the gas supply chamber. Thus, the material changes which occur during operation—for example the swelling of plastic parts—do not cause any change of the distance between the headpiece of the regulator rod and the valve seat (33).

10 Claims, 7 Drawing Figures

TEMPERATURE CONTROLLED FUEL GAS THROUGHFLOW VALVE

This application is a continuation of application Ser. No. 509,466, filed June 6, 1983 now abandoned.

BACKGROUND OF THE INVENTION

1. Field of the Invention

The present invention concerns a temperature-controlled fuel gas throughflow valve for a catalytic heating device.

2. Description of the Prior Art

With a known hair curler (German Offenleggungsschrift No. 20 40 003), the fuel conveyance device is a nozzle situated between the fuel container and the combustion chamber. A stream or flow of gaseous fuel is conducted through this nozzle into the combustion chamber. By means of such an arrangement of the nozzle and of the fuel container, the conveyance quantity of fuel and of oxygen into the combustion chamber is supposed to be controlled in an extremely uniform and precisely dosed fashion.

A catalytic heating device is also known (U.S. Pat. No. 2,997,869), in which the methanol vapor and the air are conducted to a catalyst. Here, the fuel gas flows through a tubular body, at one of whose ends a rod is disposed coaxially with respect to the tubular body, which contains the catalyst. In this way, the rod-shaped body heats up when the catalytic combustion has started.

Finally, a hair curling unit is known (European Patent Application No. 0 021 224), in which a valve device is situated in the housing between the cylindrical rod body and the guide handle. This valve device regulates the outflow of the fuel gas from the fuel gas tank, which is housed in the handle section, to the catalyst, which is situated in the rod body. This regulation here takes place in dependence on a bimetallic element and furthermore in dependence on a positioning member which can be activated manually. This known hair curling unit, according to the type of a curling iron, has the disadvantage that the accuracy of the regulation depends significantly on the quality of the material used for the handle section because, on the one hand, the associated valve device is situated in the handle section and, on the other hand, the bimetallic element is connected with the cylindrical rod body. Experience has shown that the handle section and the rod body shrink or elongate under the influence of temperature and/or humidity. As a consequence, the temperature is not maintained precisely, which can cause damage to the hair.

SUMMARY OF THE INVENTION

The present invention is based on the aim of creating a valve device for a heating apparatus, which permits regulation of the fuel gas throughflow within narrow limits, and where the properties of the materials utilized do not affect the regulation behavior. The valve device should be designed so that it can be installed as an independent component or subassembly both into hair care units as well as into other units for personal needs or for the household, for example pocket ovens, flat irons, or hotplates.

According to the invention, this is achieved by a regulator element situated in a regulator frame. A bimetallic temperature measurement element acts on the regulator element. Said measuring element is directly hinged to the valve member of the valve device, where this valve member is movable and controls the fuel supply from the fuel tank to the combustion chamber. Here, the regulator frame contains the valve element, the mount for the bimetallic temperature measuring element, and the mount for the regulator element. The regulator frame is designed integrally.

U.S. Pat. Nos. 4,374,528; 4,354,482; and 4,382,448 are incorporated herein by reference for purposes of indicating the background of the invention and illustrating the state of the art.

The invention will not be described by way of a particular preferred embodiment (a catalytic hair curling iron), reference being made to the accompanying drawings.

DESCRIPTION OF THE PREFERRED EMBODIMENT STRUCTURE

Figure 1:
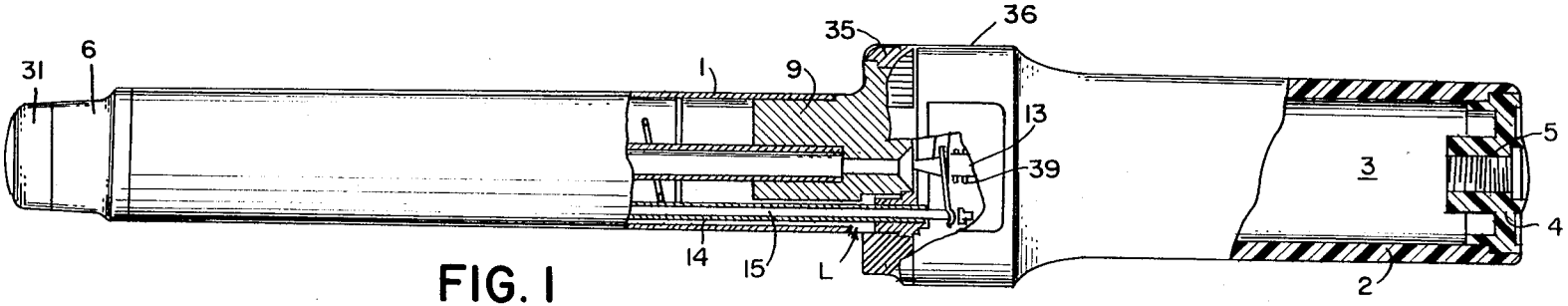
FIG. 1 shows a curling iron in a side view and in partial section.
Figure 2:
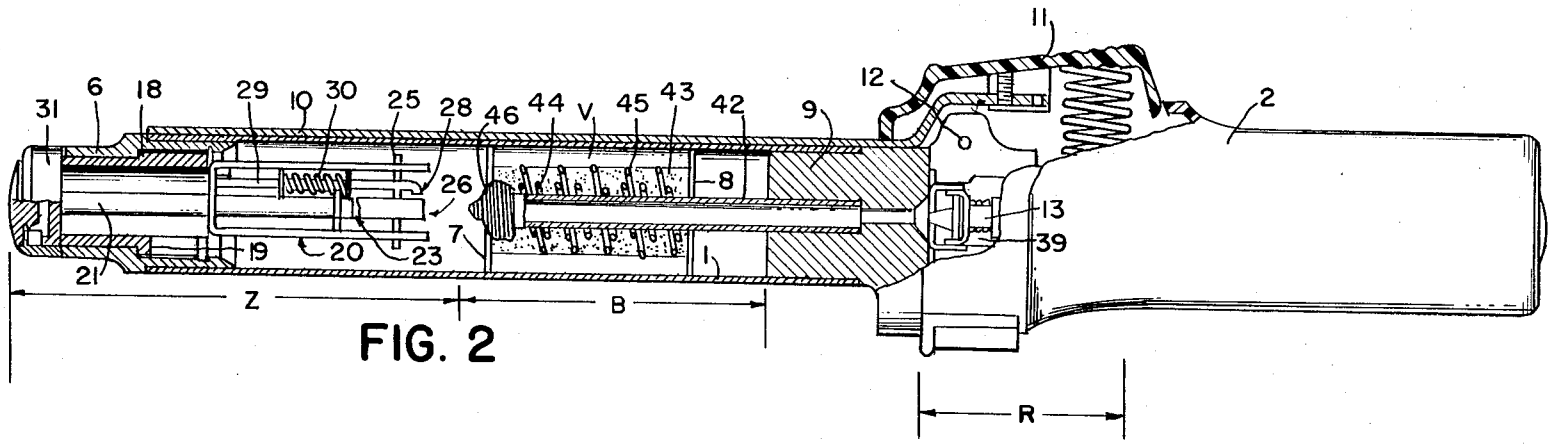
FIG. 2 shows the curling iron according to FIG. 1, in a view that has been rotated by 90°, likewise partially in section.
Figure 4:
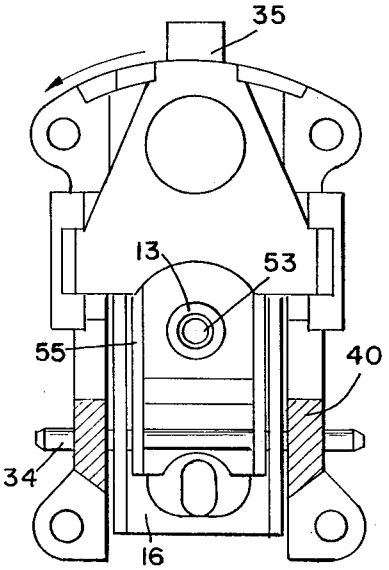
FIG. 4 shows the regulation device according to FIG. 3 in a frontal view.

The curling iron comprises: the tube 1; the handle part 2 which is connected with tube 1 and which is filled with fuel gas 3; the plug 4, together with its filling valve 5, rearwardly closing the handle part 2; the sleeve 6 which forwardly closes the tube 1; the ignition device which is held by the sleeve 6 and which in its totality is designated by Z; the burner which is held in the tube 1 by the spring windings 7, 8, and which is designated in its totality by B; the combustion chamber, designated by V; the flange 9 which is situated between the tube 1 and the handle part 2, on which the hair clamp 10 with its operating key 11 is tiltably mounted on the pin 12; and finally the valve element 13 with the regulation device consisting of parts 14, 15, 16, 17, 35, 39, 55, and 40, and which in its totality is designated by R.

The ignition device Z may be of any suitable design such as, for example, that which is taught in U.S. Pat. No. 4,374,528, a substantially similar ignition device being employed in the present preferred embodiment.

The ignition device Z comprises: the rotatable piece 18, which is moved by the activation knob 31, together with the run-up ramp 19; the holding frame 20; the tubule 21 with a spring and a flint 23, the friction wheel 26 with frontal teeth, mounted in the holding frame 20 on the pin 25; a ratchet lever with a tooth and the longitudinally movable tappet 29, mounted in the holding frame 20, with a return spring 30.

The regulation device R comprises: the valve element 13, which is longitudinally movable with respect to the valve seat 33; the regulation element or regulation lever 16, which is tiltably mounted on the pin 34; the switching lever 55; the regulator spring 17; the regulator rod 15 with the regulator tube 14; the damping spring 39; and the regulator arm 40 with the spring collet 41.

The burner B comprises: the burner tube 42; the two spring windings with a large diameter 7, 8; the catalyst 43, which is retained between an inner spring 44 and an outer spring 45; and the forward, conically wound part 46.

The flange 9 is used, on the one hand, to hold the tube 1 and, on the other hand, to hold the regulator device R. The handle part 2 holds the hair clamping device 10, 11, 12, whereby the flange 9 itself is solidly disposed at the handle part 2. L designates an air channel, through which fresh air can flow into the chamber V.

OPERATION

The curling irong according to the invention operates as follows:

After the positioning element 35 has been pivoted into the open position (arrow direction A), the fuel gas flows from the handle 2 through the valve 13, 33, 51, 52, 53, 54 into the burner tube 42, through the conically wound part 46, through the spring 44, into the chamber between the igniter Z and the burner B.

To ignite the fuel gas, the ring 31 is now turned. When the ring 31 turns, it carries along the rotary piece 18 and sets this part 18 into rotational motion. The tappet 29, which abuts the run-up ramp 19 of the rotary piece 18 is put into axial motion, since, due to the force of the return spring 30, its end continuously follows the motion of the run-up ramp 19. For this purpose, the tappet 29 is held and guided in the area of the friction wheel 26. With its forward end, it grips the holding frame 20 through an opening in the forward U-shaped part of holding frame 20. The tubule 21, which contains the flint 23, is guided by the bent tab of the frame 20 and is forwardly mounted in a hole in the holding frame 20. Through the axial motion of the tappet 29, the ratchet lever 28, which is rotatably mounted on the pin 25, is pivoted from the bent end of the tappet 29. The tooth of the ratchet lever 28 here engages the ratchet frontal teeth of the friction wheel 26 and turns this wheel apiece on the pin 25. The flint 23 in the tubule 21 is pretensioned by a spring. It now rubs against the rotating friction wheel 26, so that sparks are struck. This causes the gas mixture in the combustion chamber V between the igniter Z and the burner B to ignite.

After the gas mixture in the chamber between the igniter Z and the burner B has been ignited by activation of the igniter Z, catalytic combustion of the gas is initiated. For this purpose, the fuel gas continues to flow steadily, regulated through the valve 13, 33, 51, 52, 53, 54.

The valve element 13 is moved with respect to the valve seat 33 by the regulator lever 16. For this purpose, the lever 16 is tiltably mounted on the pin 34. The damping spring 39 acts on the regulator lever 16. The regulator spring 17 contacts the switching lever 55, which is rotatably mounted at the regulator frame 40 on the pin 34. When the positioning element 35 is pivoted, the switching lever 55 is pivoted, since the free end of the switching lever 55 engages a slot in the position element 35.

The regulator lever 16 is furthermore acted upon by a bimetallic device, which consists of a regulator tube 14 with a movable regulator rod 15 situated therein. Here, the tube 14 and the rod 15 are rigidly connected together at their forward ends at F. On the other hand, the handle-sided end of the tube 14 is solidly affixed to the regulator frame 40 by means of a spring collet 41, and the handle-sided end of the regulator rod 15 acts on the regulator lever 16 through the headpiece 46.

When the curling iron heats up, the valve 13, 33 is closed; by contrast, when the curling iron cools, said valve is open. The flow of fuel gas between 33 and 59, in the maximum valve opening position, is limited by a small, precise hole 57 in the part 40 or respectively the filter 52 and the nozzle 53, so that, in every case, only a limited amount of fuel gas can emerge.

The burner tube 14, which is situated in parallel with the catalyst 43 in tube 1, actively reacts under the influence of temperature, i.e. it strongly expands, while the regulator rod 15 expands comparatively little. The length difference yields the regulation path, or the path by which one end of the regulator lever 16 is moved by the regulator rod 15. The motion of the valve element 13 with respect to the stationary valve seat 33 can be influenced not only by the regulator rod 15 but also by the position of the positioning element 35. If the positioning element 35 is moved to the position ON (arrow direction A), the slot in the position element 35 moves towards the front, i.e. the regulator lever becomes freely movable, and the damping spring 39 is relieved. If the positioning element 35 is moved into the OFF position, the spring 17 is relieved and the damping spring 39 is pretensioned so far that the valve 13, 33 is closed gas-tight.

The valve seat 33, the pin 34, and the spring collet 41 are disposed at the regulator frame 40, which is integrally made of a high-grade material. The purpose of this is to prevent that, at operating temperature, under the influence of e.g. moisture, an unallowable play occurs at "S" (see FIG. 5) between the regulator lever 16 and the headpiece 56, i.e. the play which is necessary at this point changes from S=0.17 to 0.2 mm at 140° C. (the play S guarantees that the maximum operating temperature is not exceeded). The play S can be precisely adjusted by turning the headpiece 56, which is designed as a screw nut, on the regulator rod 15 until the required 0.17 to 0.2 mm have been set.

Figure 5:
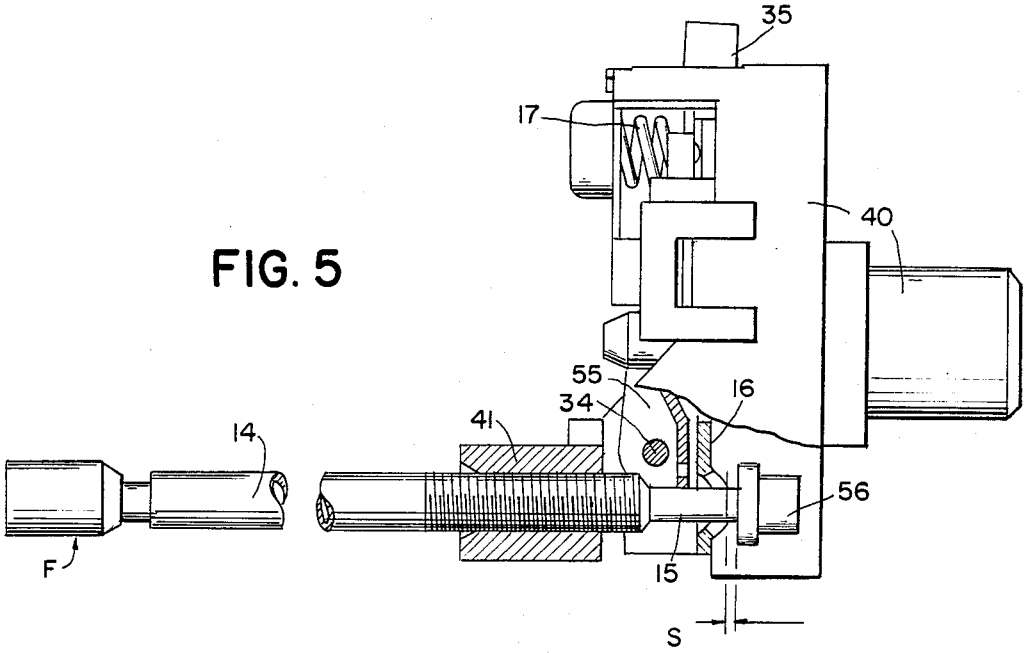
FIG. 5 shows the complete regulation device according to FIG. 3, partially in longitudinal section (with bimetallic temperature measuring element inserted).
Figure 7:
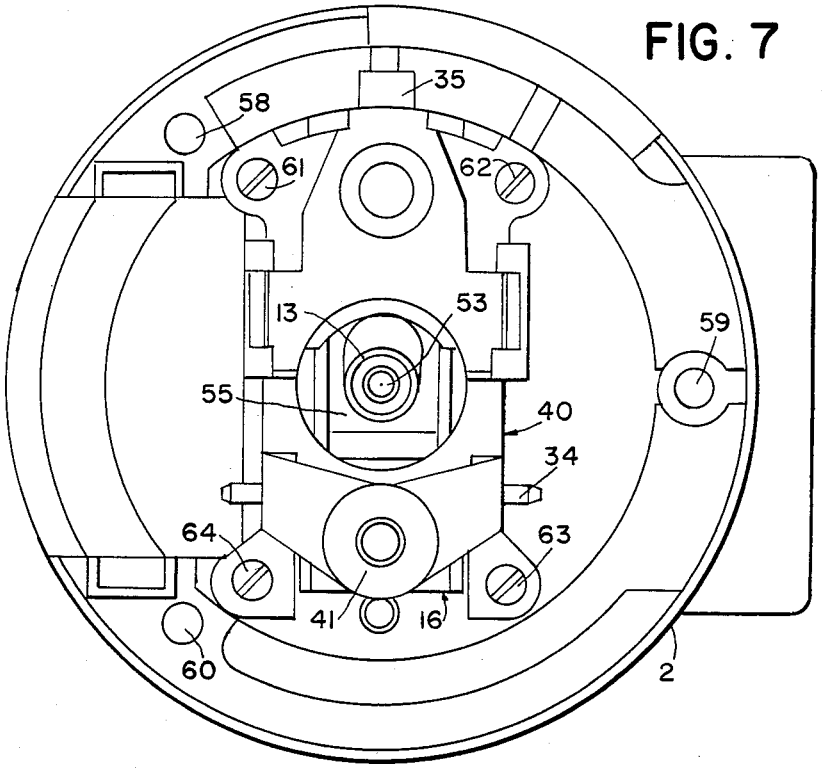
FIG. 7 shows a frontal view of the handle part according to FIG. 5.

The regulation device R, shown in FIG. 5, comprises both the bimetallic element 14, 15, 56 and the regulator levers 16, 55 together with the regulator spring 17 and the valve device 33, 51, 52, 53, 54, 57 with the regulator frame 40. It is designed as a single solid subassembly and is inserted into the curling iron according to the type of a measuring unit. This mode of construction on the one hand makes possible separate assembly, equalization, and testing of this subassembly and, on the other hand, tolerances which occur mainly in connection with temperature changes at the housing parts, do not affect the regulation of the gas flow.

Figure 3:
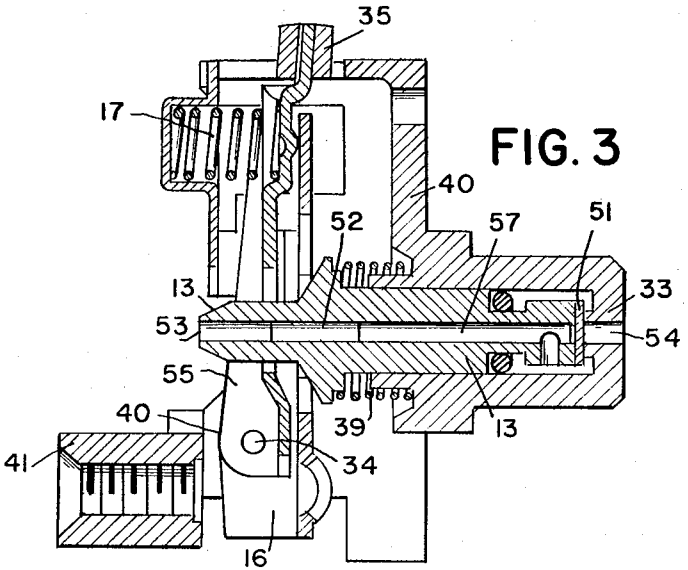
FIG. 3 shows the regulation device of the curling iron according to FIGS. 1 and 2 in an enlarged representation in longitudinal section (but without the bimetallic temperature measuring element).
Figure 6:
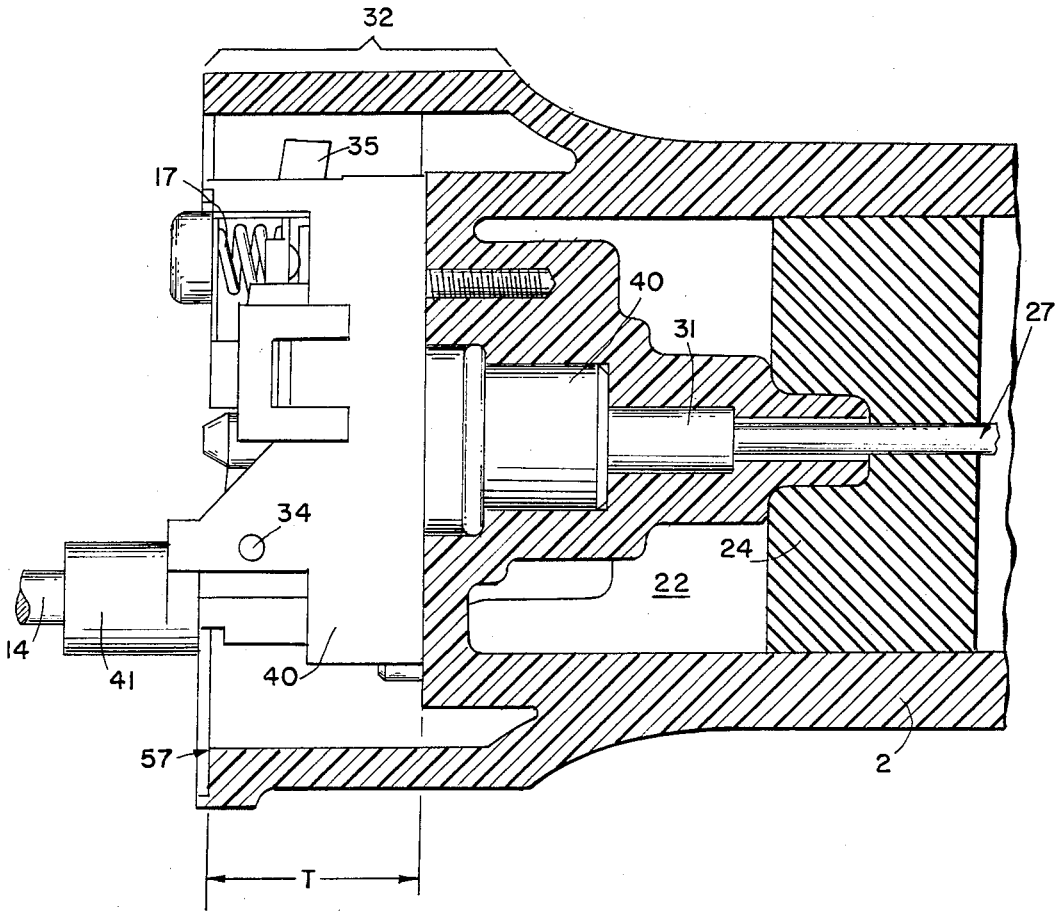
FIG. 6 shows the handle section of the curling iron according to FIGS. 1 and 2, with the regulation device inserted, in an enlarged representation, partially in longitudinal section.

As FIG. 6 shows, the regulator frame 40 is solidly screwed together with the handle part 2, which is made of plastic, and which contains the gas supply chamber 22. The handle part 2 furthermore contains foam disks 24, the wick 27, and a filter stone 31, through which the fuel gas can flow into the hole 54 (FIG. 3). In the event that the length of the cup-shaped end 32 of the handle part 2 should change (e.g. due to high temperature), the play S between the headpiece 56 and the regulator lever 16 is not influenced thereby; actually, only the total length of the device is influenced.

The tube 1 and the handle part 2 are connected together through the flange 9. On the one hand, the flange 9 is screwed together with the front surface 57 of the handle part 2 or of its cup-shaped end 32 and, on the other hand, it is wedged with the tube 1. The blind holes in the handle part 2 are designated by 58, 59, 60, into which are screwed the screws (not shown in more detail) by means of which the regulator frame 40 is fastened at the front surface of the handle part 2.

I claim:

1. In a gas powered heating device having a fuel supply chamber and a combustion chamber, an improved thermostatic gas flow control valve, comprising:

a regulator frame disposed between said fuel supply chamber and said combustion chamber and being integrally constructed of a high quality material which will not alter its shape under the influences of temperature and mechanical forces encountered during the operation of the gas powered heating device;

a fuel supply channel provided in said regulator frame;

a movable valve member disposed within said channel for controlling the flow of fuel through said channel dependent upon the positioning of said valve member;

a control member (16) pivotally mounted on said regulator frame, said control member being in contact with said valve member to thereby determine the position of said valve member; and temperature response means directly attached to said regulator frame and engaging said control member for pivotally positioning said control in response to the temperature within said combustion chamber;

whereby the position of said thermostatic control valve is only influenced by the positioning of said control member and the temperature of said temperature response means and is substantially independent of temperature related dimensional changes in other components of said heating device.

2. A valve according to claim 1, wherein the engagement between said temperature response means and said pivotally mounted control element is such that increasing the temperature of said heating device causes said control element to pivot in a first angular direction to lessen the flow of fuel through said channel, and further comprising biasing means (39) for biasing said control element in a second angular direction opposite to said first angular direction.

3. A valve according to claim 2, wherein said regulator frame includes an integrally formed valve seat for cooperating with said valve member and an integrally formed attachment member (41) for mounting said temperature response means on said regulator frame.

4. A valve according to claim 3, wherein said temperature response means comprises a bimetallic element.

5. A valve according to claim 1 wherein said material of said regulator frame is a metal.

6. A gas powered heating device having a fuel supply chamber, a combustion chamber and a thermostatic gas flow control valve, said control valve comprising:

a regulator frame disposed between said fuel supply chamber and said combustion chamber and being integrally constructed of a high quality material, which will not alter its shape under the influences of temperature and mechanical forces encountered during the operation of the gas powered heating device, and having a fuel supply channel formed therethrough;

a movable valve member disposed within said channel for controlling the flow of fuel through said channel dependent upon the positioning of said valve member within said channel;

a control member directly and pivotally mounted on said regulator frame, said control member being in contact with said valve member to thereby determine the position of said valve member within said channel; and temperature response means directly attached to said regulator frame, said temperature response means engaging said control member to pivotally displace said control member in response to the temperature of said heating device within said combustion chamber.

7. A heating device as in claim 6, wherein said control valve is directly attached to a first member forming said fuel supply chamber and wherein said combustion chamber is enclosed within a second member attached to said first member.

8. A heating device as in claim 7, further comprising a flange member (9) for structurally interconnecting said first and second members.

9. A heating device as in claim 8, wherein said heating device is a hair curling iron, said first member is a handle thereof and said second member is a winding body thereof.

10. A valve according to claim 6 wherein said material of said regulator frame is a metal.

* * * * *